United States Patent [19]

Capaul

[11] Patent Number: 4,796,397

[45] Date of Patent: Jan. 10, 1989

[54] DEMOUNTABLE PANEL STRUCTURE

[76] Inventor: Raymond W. Capaul, Route #3, Wildwood Drive, Aurora, Ill. 60504

[21] Appl. No.: 98,794

[22] Filed: Sep. 21, 1987

[51] Int. Cl.[4] ..... E04B 1/82

[52] U.S. Cl. ..... 52/144; 52/806; 52/809; 52/DIG. 13; 428/116

[58] Field of Search ..... 52/DIG. 13, 806, 809, 52/144, 145; 428/116, 117

[56] References Cited

U.S. PATENT DOCUMENTS

| | | | |
|---|---|---|---|
| 3,021,916 | 2/1962 | Kemp | 52/794 |
| 3,391,434 | 7/1968 | Girard | 52/DIG. 13 |
| 3,475,810 | 11/1969 | Mates | 52/483 |
| 4,084,367 | 4/1978 | Saylor et al. | 52/809 |
| 4,112,164 | 9/1978 | Koss | 428/251 |
| 4,462,193 | 7/1984 | Ericson | 52/DIG. 13 |
| 4,465,725 | 8/1984 | Riel | 52/806 |
| 4,496,024 | 1/1985 | Wolf et al. | 156/306.6 |
| 4,522,284 | 6/1985 | Fearon et al. | 428/116 |

*Primary Examiner*—James L. Ridgill, Jr.

*Attorney, Agent, or Firm*—Wallenstein, Wagner, Hattis & Strampel

[57] ABSTRACT

A demountable acoustical panel structure having a honeycomb core, and a thin, dense, sound transmitting glass fiber sheet of uniform thickness adhered to each of the oposed major surfaces of the core. One of the thin sheets advantageously carries segments or patches of a separable fastening means to enable the panel structure to be installed on a supporting surface provided with cooperating segments or patches of a separable fastening means by simply aligning said fastening means.

9 Claims, 2 Drawing Sheets

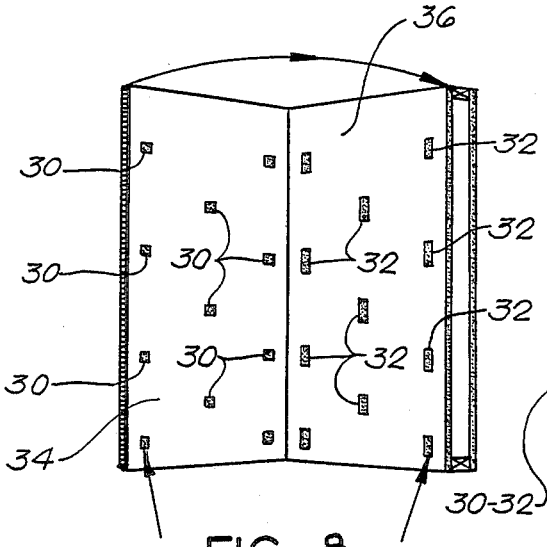
FIG. 8
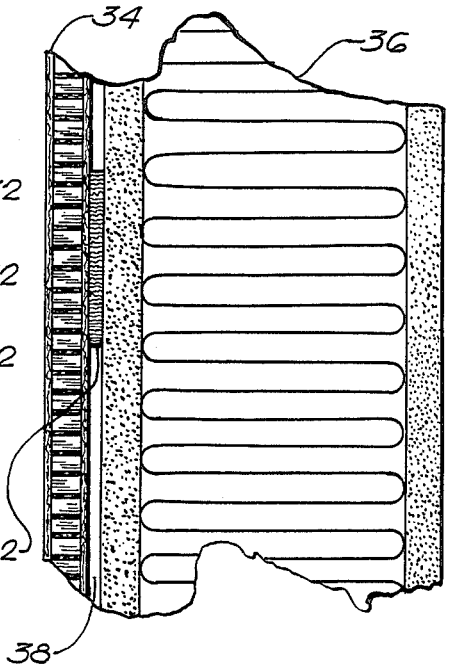
FIG. 9
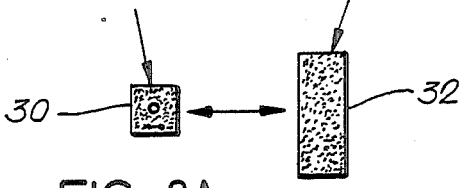
FIG. 8A
FIG. 8B
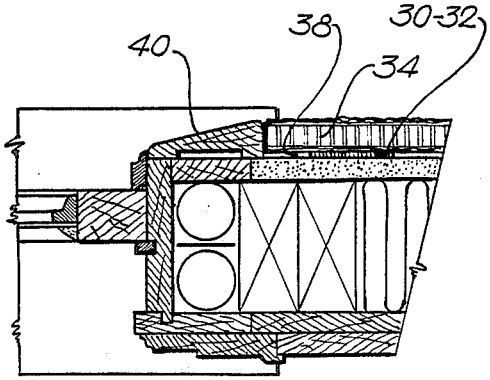
FIG. 10
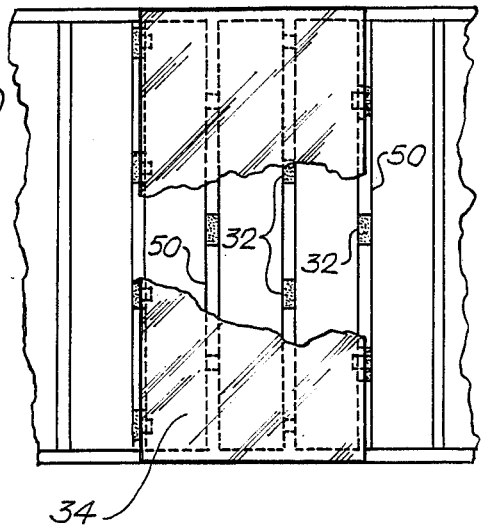
FIG. 11

DEMOUNTABLE PANEL STRUCTURE

FIELD OF THE INVENTION

The present invention relates to a honeycomb cored, acoustical panel structure which can be applied by hand pressure to a surface without the need for adhesives or mastics, and, if desired, can be demounted from the surface without damage to the panel structure or the underlying supporting surface.

BACKGROUND OF THE INVENTION

Acoustical-type panels employing a honeycomb core are the subject matter of a number of patents. Thus, in U.S. Pat. No. 3,021,916 there is disclosed a panel structure comprising a honeycomb core, the cells of which are filled with loose sound deadening material such as plastic fiber, glass fiber, wool, or the like. The core is sandwiched between a perforated metal or plastic pan and a sound reflecting pan made of the same material as the perforated pan. Panels of this type are usually made by applying an adhesive to the honeycomb core and/or the inner surfaces of the pans, and, while positioned in stacked relation to one another on a hot press, pressure and heat are applied to cure the adhesive.

In U.S. Pat. No. 4,084,367, a honeycomb core is used on opposite sides of a septum or divider. The panel shown in the patent includes apertured sheet metal skins providing a single, small diameter opening in register with each cell of the split honeycomb core. The sheet metal skins are covered by a thick layer of porous sound absorbing material such as fiberglass. The entire structure is encased in a rigid metal frame formed of a plurality of channel-shaped rails. The skins are bonded to both the core and the frame to increase the rigidity and strength of the structure.

In U.S. Pat. No. 4,496,024 a sound absorbing panel is shown in which a honeycomb core has bonded to each side thereof a porous fiberglass pelt. Bonding of the pelts to the core is accomplished by placing a layer of a thermoplastic sheet material between the core and each pelt, placing the stacked layers between the upper and lower heated surfaces of a platen press, and subjecting them to pressure and heat sufficient to bring about liquification of the thermoplastic sheet material. The pressure applied to the stacked layers acts to partially press the porous pelts and the thermoplastic sheet material into the cells of the honeycomb core. The pelts are impregnated with a phenolic resin binder, and have an initial thickness of one inch. The total compressed thickness of the end product is two inches.

Yet another honeycomb cored panel is the subject matter of U.S. Pat. No. 4,522,284. The structure shown in the patent comprises a honeycomb core having a homogeneous fibrous layer bonded to each surface thereof. The fibrous layers are formed from uncured fiberglass batts impregnated with a heat curable binder. The structure is formed by assembling the honeycomb core and the uncured batts in stacked relationship, and placing them in a hot platen press. The structure is then molded to cause a surface of the batts to enter the cells of the core to impart a pillowlike configuration to the said surface. The finished panel has thickness of 1 or 2 inches.

The use of metal parts in the fabrication of acoustical-type panels as disclosed in U.S. Pat. Nos. 3,021,916 and 4,084,367 adds significantly not only to the cost of the end product, but, also the cost of manufacturing such panels. In addition, the use of metal parts in combination with non-metallic parts, coupled with the need for using a heated platen press to form an integrated structure, in the fabrication of the panels, does not render the panels adaptable to a high-speed, in-line mass production operation. The same applies with respect to the panels disclosed in U.S. Pat. Nos. 4,496,024 and 4,522,284 in that each requires the use of a heated platen press to attain a desired result. Furthermore, in the case of all of the panels shown in said patents, the mass of the panels makes them unsuitable for use as demountable panels, that is, lightweight acoustical structures which can be applied to a surface by hand pressure, using separable fastening means of the hook and loop type, for example, and which, if desired, can be demounted from said surface in the same manner without damage to the panels or the surface from which they are demounted.

SUMMARY OF THE INVENTION

In accordance with the present invention, a lightweight, yet high strength, demountable acoustical panel structure has been evolved which not only overcomes all of the shortcomings and deficiences noted above with regard to honeycomb cored panels such as those disclosed in the aforementioned U.S. patents, but, also, can be produced at a fraction of the cost of such prior art panels. The structure lends itself to fabrication in a high-speed, in-line operation which results in finished panels of any desired predetermined dimensions ready to install. Installation of the finished panels can be accomplished without the need for using conventional panel retaining materials such as mastics, pastes, clips, or nails. A further important feature of the panels is that they have a flame spread which qualifies them for a Class A fire rating.

The acoustical panel structure, in brief, essentially comprises a honeycomb core to the opposed major surfaces of which are adhered thin, dense, sound transmitting, substantially homogeneous, sheets of fiberglass of substantially uniform thickness. Both surfaces of the sheets are smooth and even, and lie in planes substantially parallel to the cell end planes of the honeycomb core. One side of the finished panel advantageously is provided with segments or patches of a separable fastening means positioned in spaced, preselected relation on said side of the panel. The opposite side of the panel advantageously is provided with a decorative coating or layer which may comprise paint, or, in a preferred embodiment of the invention, a woven or non-woven fabric. The separable fastening means on said one side, in cooperation with like means positioned on a support surface at the installation site, enables the panel to be applied to the support surface by hand pressure. No tools are needed except to cut the panel to size as required by the dimensions of the support surface. The panel installation can be demounted from the support surface without damage to the panels or the support surface. The thickness or depth of the panel structure is such that it can be butted against the trim around doors and windows to give the panel installation a finished, attractive appearance. The separable fastener means employed to secure the panel on a supporting surface acts to provide a narrow, "dead air" space between the inner surface of the panel and the support surface which enhances the acoustical properties of the completed installation.

BRIEF DESCRIPTION OF THE DRAWINGS

FIGS. 8, 8A and 8B illustrate embodiments of a hook and loop type fastener for use in installing the panel structure of this invention on a supporting surface, the portion of the fastener provided on the panel structure being illustrated in FIG. 8A, and the cooperating portion of the fastener attached to the supporting surface being illustrated by FIG. 8B;

FIG. 9 is a fragmentary, vertical sectional view showing the relationship of the panel structure, the hook and loop type fastener, and the supporting surface of a finished installation;

FIG. 10 is a fragmentary, horizontal sectional view showing the edge of the panel structure in abutting relation to the edge of a window frame; and FIG. 11 is a view corresponding to FIG. 8, with the separable fastening means arranged on the wooden studding of a wall.

DETAILED DESCRIPTION OF THE INVENTION

Figure 2:
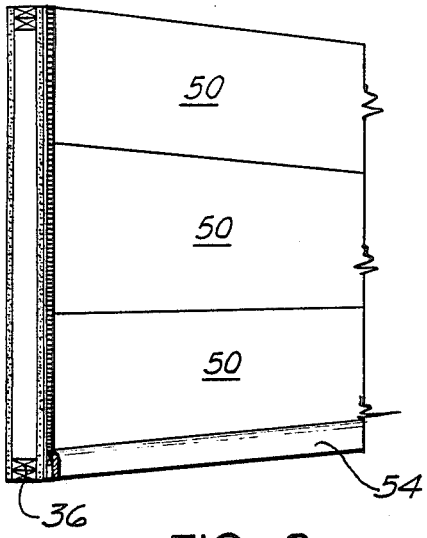
FIG. 2 is a view in perspective showing said embodiment of the invention arranged horizontally in abutting relation on a supporting surface.
Figure 3:
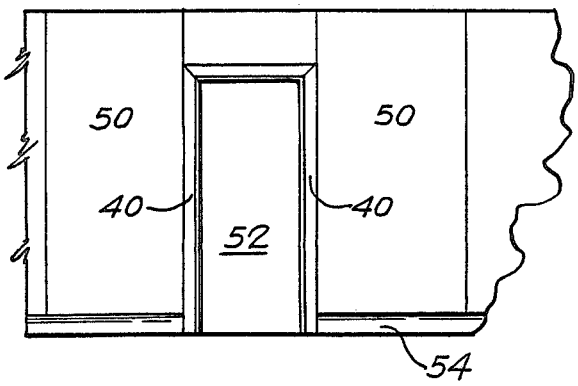
FIG. 3 is a front view in elevation showing said embodiment of the panel installed on a supporting surface with a doorway.
Figure 4:
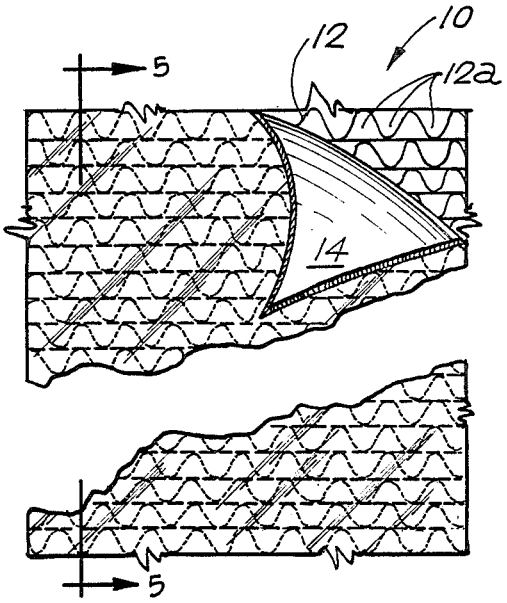
FIG. 4 is a fragmentary top plan view of a section of said embodiment of the panel with a portion of the fiberglass layer or sheet peeled back to show the honeycomb core.
Figure 5:
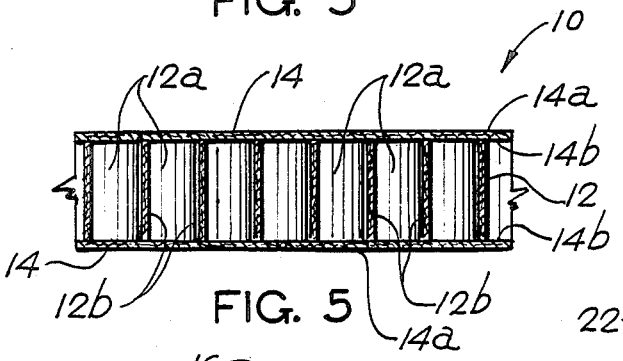
FIG. 5 is a sectional view taken substantially along line 5—5 of FIG. 4.

Referring, now, to FIGS. 2 and 3 of the drawings, the embodiment of the panel structure illustrated, and designated generally by reference numeral 10, comprises a cellular body portion or core 12 having a thin, substantially homogeneous facing material 14 secured to each side thereof. The cellular core 12 preferably is a walled structure such as a honeycomb formed of cardboard, kraft paper, plastic, a lightweight metal, or the like. The thickness of the core 12 can range from about ¼ inch to about 1 inch, preferably from about 0.4 inch to about 0.6 or 0.8 inch. The size of the cells **12*a* comprising the core 12** can range from about ¼ inch to about ¾ inch, with a cell diameter size of about ⅜ inch being preferred.

The facing material 14 is secured to the end edges of the walls **12*b* which define the cells 12*a* of the honeycomb core 12. As shown, the outer surface 14*a* and the inner surface 14*b* of the facing material 14 lie in parallel planes and no portion of the inner surface 14*b* extends into the cells 12*a* comprising the core 12. The facing material 14** advantageously is in the form of a thin, dense, sound transmitting, substantially homogeneous, non-woven glass fiber mat having a thickness in the range from about 0.010 to about 0.020 inch, preferably about 0.015 to about 0.018 inch, and a density of the order of about 8 to about 12 lbs. per cubic foot, preferably about 9 to about 10 lbs. per cubic foot. The glass fibers comprising the mat are arranged in a random pattern and are bonded together with a resinous binder. The density and composition of the facing material resists penetration and provide a smooth surface which promotes adhesion and film continuity.

Figure 6:
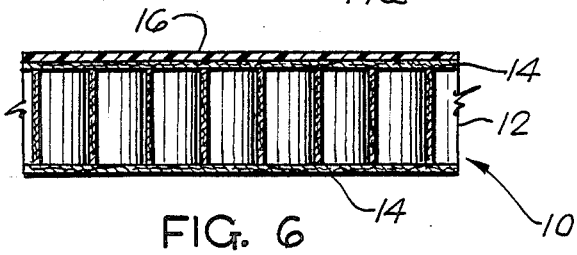
FIG. 6 is a view corresponding to the view of FIG. 5 showing a decorative layer on one side of the panel.

As shown in FIG. 6, a layer or film 16 of a decorative material can be applied to the facing material 14 on one side of the panel structure 10. The layer or film 16 can comprise a latex based paint, or, preferably, a sheet formed of open-weave natural or synthetic fabrics, or combinations thereof. Especially preferred are fabrics formed of woven, spun or filament plastics such as vinyls and polyesters, and glass fibers. The decorative layer or film acts to increase the sound absorption properties of the panel to provide a structure having a noise reduction coefficient of the order of 50, more or less. The thickness of the decorative layer or film can range for about 2 to about 8 mils, but desirably is about 4 to 5 mils.

Figure 7:
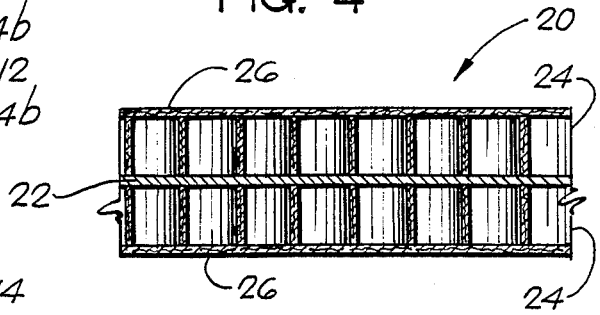
FIG. 7 is a vertical sectional view of another embodiment of the panel of this invention showing a septum positioned in the honeycomb core.

In FIG. 7, the embodiment of the panel structure designated generally by reference numeral 20 shown incorporates a septum 22 in the honeycomb core 24. The core 24, like the core 12, has thin, dense glass fiber sheets 26 adhered to the outer, opposed major surfaces thereof. As shown, the core 24 is divided into two sections and the septum 22 is interposed therebetween. The septum 22 may be formed of a metal foil such as aluminum foil or lead foil, or it may be fabricated of a synthetic plastic film such as vinyls and polyesters. Kraft paper, and fiber glass, or glass felt sheets may also be used. The septum acts to enhance the sound transmission characteristics of the panel structure, as well as a means for providing an effective barrier to the passage of dirt ladened air through the panel. The thickness of the septum can range from about 0.5 to about 5 mils, more or less.

As stated hereinabove, the panel structure of the present invention can be manufactured in an in-line, continuous, high-speed operation at a fraction of the cost incurred in the manufacture of a honeycomb cored structure such as the one disclosed in U.S. Pat. No. 4,522,284, for example. The panel structure of this invention is especially adaptable to fabrication in a double facing laminating operation which includes the steps of coating both sides of the honeycomb core with a suitable adhesive, and then applying, simultaneously, the thin glass fiber mats to the adhesive coated surfaces of the core. The thusly formed laminated structure is then passed into an oven heated to a temperature of from about 90° to 140° F. to cure the adhesive. From the oven, the structure is passed through a cooling station, and then between nip rollers to assure proper adhesion between the core and the mats. The thusly formed panel structure is then cut to size and stacked. Cut panel sizes can range from 2′×10′ to ′×10′. The entire operation is performed at a line speed of about 40–50 ft/min.

In accordance with a preferred practice of the present invention, the panels, after they are cut to size, are provided with segments or patches of fastener means as best shown in FIGS. 8A, 8B and 8C of the drawing. The segments or patches 30 are positioned in spaced, staggered relation to one another on one side of the panel structure 34 after the panels are cut to size, and are adapted to interlock with correspondingly spaced, and staggered segments or patches 32 of cooperating fastener means positioned on a supporting surface such as wall 36, at the job site, on which the panel structure 34 is to be mounted. In a preferred embodiment of the invention, the segments or patches 30 and 32 of the fastener means are formed of hook and loop type fasteners available commercially under the designation VALCRO. Each segment or patch desirably has a pressure sensitive adhesive film or coating on one surface thereof to enable it to be secured to the panel 34 and the supporting surface 36. The adhesive film or coating on the segments or patches 32 which are placed in position at the installation or job site is provided with a release coated backing strip which is removed by the installer prior to applying the segments or patches 32 to a supporting surface. In this connection, it should be mentioned that while the segments or patches 32 are illustrated in position on a wall 36, the segments or patches 32 can also be positioned on the wooden or metal wall studs 50 of an unfinished wall as shown in FIG. 11.

Referring, in particular, to FIGS. 9 and 10, the segments or patches 30 and 32 act to maintain the panel structure 34 in spaced relation to the wall 36. The "dead air" space 38 thusly formed can range in depth from about $\frac{1}{4}$ to about $\frac{1}{2}$ inch, and serves to enhance the acoustical properties of the panel structure. Also, as best illustrated in FIG. 10, the dimensions of the panel structure of this invention enable it to flush out with door and window trim such as door trim 40, thereby providing a finished appearance to an installation, and eliminating the labor and material costs which otherwise would be incurred in the absence of this feature of the panel structure.

Figure 1:
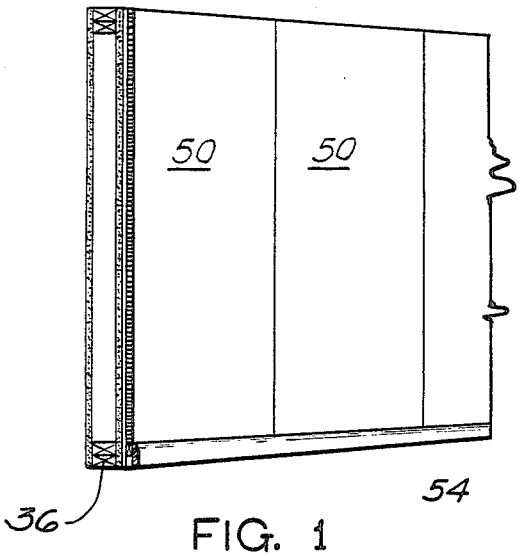
FIG. 1 is a view in perspective showing an embodiment of the panel of this invention installed on a supporting surface with the panels arranged in vertical, side-by-side abutting relation on the surface.

In FIGS. 1, 2 and 3 of the drawings, typical installations utilizing the panel structure of this invention are illustrated. As shown in FIG. 1, the panels 50 are vertically oriented in abutting relation to one another whereas in FIG. 2 they are horizontally oriented in abutting relation to each other. FIG. 3, again, illustrates the finished appearance attainable with the panel structure around the trim 40 of a door 52 and base board 54 of a typical room or office. While the seams between panels are visible in the drawings, in an actual finished installation, wherein the panels used are faced with a fabric as shown in FIG. 6, the seams are essentially invisible.

The use of hook and loop type fasteners enables the panel structure of this invention to be readily demounted from a supporting surface without damage either to the panel or the supporting surface. This feature facilitates any changes in room decor, or reconstruction, which may be needed, and enables ready access to areas behind the panel structure for making repairs, or adding electrical outlets, for example. Although the use of hook and loop type fasteners is preferred, it should be understood that other fastening means such as clips, or mastics can be used to install the panel structure of this invention on a supporting surface.

The panel structure of the present invention has a flame spread of less than 25, which qualifies it for a Class A fire rating.

While for purposes of illustration representative embodiments of the invention have been shown and described, other embodiments of the invention may become apparent to those skilled in the art upon reference to this disclosure without departing from the spirit and scope of the invention.

What is claimed is:

1. A demountable acoustical ceiling and wall panel structure, consisting essentially of: a lightweight core member in the form of a honeycomb having wall portions defining a plurality of open-ended cells and opposed cell end planes; a single-ply, thin, dense, sound transmitting, substantially homogeneous, glass fiber sheet of substantially uniform thickness secured to each of the opposed major surfaces of the core member in substantially parallel relation to each other and to said cell end planes; separable fastening means secured in preselected spaced relation on the exposed surface of one of said single-ply glass fiber sheets to enable the panel structure to be demountably secured on a supporting surface provided with cooperating separable fastening means with only hand pressure; and decorative coating on the exposed surface of the other of said single-ply glass fiber sheets, said panel structure having a flame spread of less than 25.

2. A panel structure according to claim 1 wherein the glass fiber sheets have a uniform thickness of about 0.010 to about 0.020 inch and a uniform density of about 8 to about 12 lbs/ft$^3$ throughout.

3. A panel structure according to claim 1 wherein the core member is formed of kraft paper or cardboard, and has a thickness of about $\frac{1}{4}$ to about inch.

4. A panel structure according to claim 1 wherein the separable fastening means comprises segments of cooperating hook and loop type fasteners.

5. A ceiling and wall panel structure according to claim 1 wherein the core member comprises two sections, said sections having interposed therebetween a septum positioned in substantially parallel relation to and intermediate the single-ply glass fiber sheets secured to each of said opposed major surfaces of the core member, said septum acting to provide a barrier to the passage of dirt ladened air through the panel structure and to enhance the sound transmission properties thereof.

6. An acoustical wall panel installation, comprising: a panel supporting surface having separable fastening means secured in preselected spaced relation thereon; and a plurality of hand demountable acoustical panels positioned in abutting relation on said surface, said panels each being provided with a lightweight core member in the form of a honeycomb having wall portions defining a plurality of open-ended cells and opposed cell end planes, the opposed major surfaces of the core member having a single-ply, thin, dense, sound transmitting substantially homogeneous, glass fiber sheet of substantially uniform thickness secured thereon in substantially parallel relation to each other and to said cell end planes, one of said glass fiber sheets having separable fastening means secured in preselected spaced relation thereon for engaging the separable fastening means on said panel supporting surface with only hand pressure, said separable fastening means on the panel supporting surface and said panels acting to maintain the panels in spaced relation to the panel supporting surface to provide a sound insulating space therebetween, said panel structure having a flame spread of less than 25.

7. A panel installation according to claim 6 wherein each of the acoustical panels has a thickness of about $\frac{1}{4}$ to about 1 inch, a noise reduction coefficient of at least 50, and a flame spread less than 25.

8. A demountable acoustical ceiling and wall panel structure, consisting essentially of: a lightweight core member in the form of a paper honeycomb having wall portions defining a plurality of open-ended cells and opposed cell end planes, said core member having a thickness of about $\frac{1}{4}$ to about 1 inch; a single-ply, thin, dense, sound transmitting, substantially homogeneous, glass fiber sheet of substantially uniform thickness adhered to each of the opposed major surfaces of the core member in substantially parallel relation to each other and to said cell end planes, each of said single-ply sheets having a thickness of about 0.010 to about 0.020 inch and a density of about 8 to about 12 lbs/ft.$^3$ throughout; separable fastening means secured on the exposed surface of one of said single-ply glass fiber sheets; and a decorative coating on the exposed surface of the other of said single-ply glass fiber sheets, said panel structure having a flame spread of less than 25.

9. A ceiling and wall panel structure according to claim 8 wherein the core member comprises two portions separated by a septum which serves to provide a barrier to the passage of dirt ladened air through the panel structure and to enhance the sound transmission properties thereof.

* * * * *